US008036392B2

(12) United States Patent
Fröhlich

(10) Patent No.: US 8,036,392 B2
(45) Date of Patent: Oct. 11, 2011

(54) METHOD AND DEVICE FOR DETERMINING AN EFFECTIVE VENT

(75) Inventor: Matthias Fröhlich, Erlangen (DE)

(73) Assignee: Siemens Audioligische Technik GmbH, Erlangen (DE)

( * ) Notice: Subject to any disclaimer, the term of this patent is extended or adjusted under 35 U.S.C. 154(b) by 1069 days.

(21) Appl. No.: 11/899,551

(22) Filed: Sep. 6, 2007

(65) Prior Publication Data

US 2008/0175401 A1 Jul. 24, 2008

(30) Foreign Application Priority Data

Sep. 7, 2006 (DE) ..... 10 2006 042 083

(51) Int. Cl.
*H04R 29/00* (2006.01)

(52) U.S. Cl. ..... 381/58; 381/60; 381/321

(58) Field of Classification Search ..... 381/58, 381/60, 321
See application file for complete search history.

(56) References Cited

U.S. PATENT DOCUMENTS 7,650,005 B2 * 1/2010 Chalupper ..... 381/320
2002/0176584 A1 11/2002 Kates

FOREIGN PATENT DOCUMENTS

DE 102006042083 A1 3/2008
EP 2003928 A1 12/2008
WO 2005081584 A2 9/2005
WO 2007045271 A1 4/2007

* cited by examiner

*Primary Examiner* — Tu-Tu Ho

(57) ABSTRACT

The acoustic properties of so-called instant fit ear tips, which in contrast to otoplastics are not produced individually, should be able to be better taken into consideration when adjusting a hearing aid for an individual wearer. To this end a method is proposed in which an OLG measurement, in other words an open loop gain measurement, is performed on the hearing aid when it is being worn. The OLG measurement curve obtained is compared with an OLG reference curve. A value is ascertained from the comparison which represents the level of closure of the hearing aid or of its otoplastic in the ear of the wearer. On the basis of this value the gain of the hearing aid is finally corrected. Furthermore, a corresponding adjustment device is provided. It is thus possible in a simple manner to take into consideration the individual, current level of closure during the adjustment.

20 Claims, 1 Drawing Sheet

METHOD AND DEVICE FOR DETERMINING AN EFFECTIVE VENT

CROSS REFERENCE TO RELATED APPLICATIONS

This is application claims priority of German application No. 10 2006 042 083.7 filed Sep. 7, 2006, which is incorporated by reference herein in its entirety.

FIELD OF THE INVENTION

The present invention relates to a method for determining an effective vent and a corresponding method for adjusting the gain of a hearing aid by performing an OLG measurement (open loop gain) on the hearing aid when it is being worm. Furthermore, the present invention relates to a corresponding device for determining an effective vent for a hearing aid.

BACKGROUND OF THE INVENTION

Hearing aids are wearable hearing devices which serve to support the hard of hearing. In order to accommodate the numerous individual requirements, different styles of hearing aids such as behind-the-ear hearing aids (BTE), in-the-ear hearing aids (ITE) and concha hearing aids are made available. The hearing aids listed by way of example are worn on the outer ear or in the auditory canal. Furthermore however, bone conduction hearing aids, implantable or vibrotactile hearing aids are also available on the market. In this situation, stimulation of the damaged hearing is effected either mechanically or electrically.

Hearing aids always have as their essential components an input converter, an amplifier and an output converter. The input converter is as a general rule a receiving transducer, for example a microphone, and/or an electromagnetic receiver, for example an induction coil. The output converter is usually implemented as an electroacoustic converter, for example a miniature loudspeaker, or as an electromechanical converter, for example a bone conduction earpiece. The amplifier is normally integrated into a signal processing unit. This basic structure is illustrated in FIG. 1 by way of example of a behind-the-ear hearing aid. One or more microphones 2 for receiving the ambient sound are built into a hearing-aid housing 1 for wearing behind the ear. A signal processing unit 3, which is likewise integrated into the hearing-aid housing 1, processes the microphone signals and amplifies them. The output signal from the signal processing unit 3 is transferred to a loudspeaker or earpiece 4 which outputs an acoustic signal. The sound is transferred if need be by way of a sound tube, which is fixed in the auditory canal by means of an otoplastic, to the eardrum of the device wearer. The power supply for the hearing aid and in particular that for the signal processing unit 3 is provided by means of a battery 5 similarly integrated into the hearing-aid housing 1.

With regard to open hearing aid fitting, instead of individually produced ear fitting pieces or otoplastics, so-called "instant fit ear tips" are common. These ear tips are not produced individually. They are supplied for open hearing aid fitting, but also for a closed fitting. The choice of the ear tip determines, among other things, the outflow of low frequencies from the auditory canal. This outflow must be taken into consideration with regard to the individual adjustment, particularly the adjustment of the gain, to suit the hearing aid wearer.

The use of such types of instant fit ear tips means that the seating of the ear tip and thus also its acoustic properties depend on the individual physiognomy. In the situation when an open ear tip is used, in the case of a narrow auditory canal it is actually possible for an appreciable closure to be present, so that effectively a far more closed provision results than intended. On the other hand, when a "closed" ear tip is used, in the case of a wide auditory canal or in the event of incorrect seating a significant leakage effect can occur. An individual level of closure or an "effective vent" is thus always produced by the ear tip.

Up to now this problem has only been incompletely resolved. Since a vent results in the signal feeding back and thus leads to whistling if the gain is sufficiently high, the gain can be limited to the extent that no feedback whistling occurs. To this end, measurements of the open loop gain (OLG) are performed in order to ascertain the maximum possible gain and to keep the gain correspondingly small in practice. In addition, the gain prescribed by the adjustment formula is normally modified such that the acoustic effects of the existing vent are compensated for. With regard to the use of instant fit ear tips, it is however assumed that an open ear tip is by definition open and a closed ear tip is by definition closed. The individual, actual seating of the ear tip is not incorporated in the adjustment formula.

A device and a method for measuring the performance, for adjusting and for initializing a hearing aid are known from the publication US 2002/0176584 A1. For the adjustment of a hearing aid whose ear tip has a vent, a check is first made as to whether the target gain lies below a maximum stable gain. If this is not the case, a check is made as to whether the vent in the ear tip is too large and, if necessary, needs to be reduced in size. In addition, it is also possible to check whether the leakiness of the ear tip is too great by measuring the maximum stable gain in the case of a closed vent and of an open vent. If, when the vent is closed, the maximum stable gain is not significantly greater, the ear tip should be better adjusted to the auditory canal.

SUMMARY OF THE INVENTION

The object of the present invention thus consists in better taking into consideration the actual acoustic circumstances when adjusting a hearing aid.

This object is achieved according to the invention by a method for determining an effective vent of a hearing aid by performing an OLG measurement on the hearing aid when it is being worn, comparing the OLG measurement with an OLG reference curve, and ascertaining a value which represents the level of closure of the hearing aid or of its otoplastic in the ear of the wearer, from the comparison. A correction of the gain of the hearing aid can be made on the basis of the ascertained value.

In addition, the invention provides for a device for determining an effective vent of a hearing aid with a measuring facility for performing an OLG measurement on the hearing aid, a comparison facility for comparing the OLG measurement with an OLG reference curve and a computing facility for ascertaining a value which represents the level of closure of the hearing aid or of its otoplastic in the ear of the wearer, from the comparison obtained by the comparison facility. Through the computing facility, it is possible in the context of an adjustment, where appropriate, to ascertain a gain correction value or a corrected gain value on the basis of the ascertained value.

In an advantageous manner, even when using an instant fit ear tip, the actual individual level of closure by the ear tip is thus taken into consideration for the adjustment. In this situation, a measure of an effective vent is obtained by means of an OLG measurement, which then influences the adjustment accordingly.

Advantageously, the OLG measurement takes place in one or more predefined band ranges of the audible frequency spectrum. By this means, the effective vent can be taken into consideration more specifically in the frequency ranges concerned.

The OLG measurement and the comparison with an OLG reference signal can if necessary be performed only in a low-frequency range. This represents a simplified variant compared with a wide-banded analysis since a vent makes itself felt primarily in the low-frequency range up to about 1 kHz.

With regard to a special embodiment, the comparison between the OLG measurement and the OLG reference curve can take place by means of a distance measurement. The difference then allows conclusions to be drawn concerning the quantity or quality of the vent.

Alternatively, the comparison between the OLG measurement and the OLG reference curve can also performed on the basis of a cluster assignment or other linear or nonlinear assignments. This means that other acoustic properties of the vent, which do not result simply from the determination of distance, can also be taken into consideration.

With regard to a further embodiment, the level of closure of the ear tip can be explicitly ascertained and used for correcting the gain. This means that the audiologist receives a value which gives him information about the actual size of the vent. He is thus also able to allow his experience to come into play as to the extent to which the vent actually resulting is beneficial to the hearing aid wearer or not.

BRIEF DESCRIPTION OF THE DRAWINGS

The present invention will be described in detail with reference to the attached drawings. In the drawings.

DETAILED DESCRIPTION OF THE INVENTION

The embodiments described in detail in the following represent preferred embodiments of the present invention.

Figure 1:
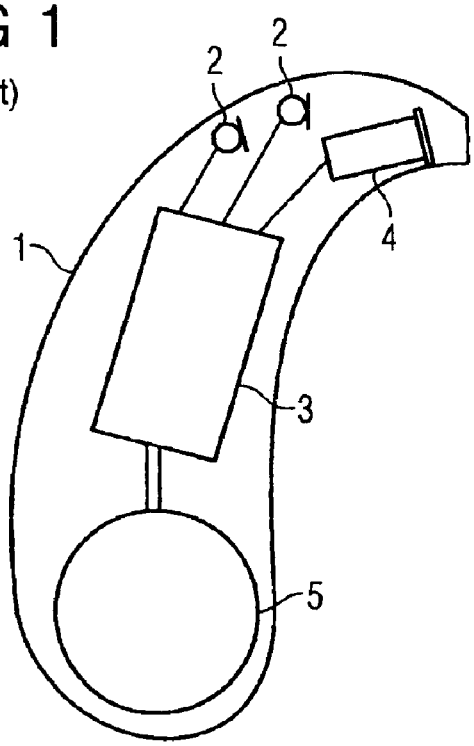
FIG 1 (Prior art)
FIG. 1 shows the schematic structure of a behind-the-ear hearing aid according to the prior art and FIG. 2 shows a block diagram representing the adjustment method according to the invention.

For adjustment purposes the hearing aid, which is illustrated symbolically in FIG. 1, is connected in wireless or wired fashion to an adjustment device. Furthermore, it is mounted in/on the ear of the hearing aid wearer in the intended manner.

The basic idea of the invention consists in the fact that the level of closure with which an ear tip closes the auditory canal can be concluded from an OLG measurement. With regard to an OLG measurement, the open loop gain is ascertained by way of the frequency. This means that the feedback is separated at the amplifier of the signal processing unit 3 of the hearing aid and the maximum gain is measured depending on the frequency at which there is not yet any feedback whistling or other feedback artifacts. According to step S1 in FIG. 2, an OLG measurement is thus performed on the hearing aid having an instant fit ear tip or an ear adapter in which the vent is not known. The OLG measurement takes place in one or more special band ranges.

In the adjustment device typical OLG reference curves are provided for example in a database according to step S2. These OLG reference curves can relate to instant fit ear tips or individually produced ear adapters, to open and closed ear adapters etc.

In a comparison facility, the OLG measurement curve obtained in step S1 is compared in step S3 with one or more OLG reference curves which are made available according to step S2. The comparison occurs only for a particular frequency range if applicable, for example only the low frequencies in the lower third of the audible spectral range. The comparison can be performed on the basis of simple, if applicable frequency-weighted separation dimensions, for example frequency-weighted rms errors (root mean square), over particular curve ranges. Alternatively, the comparison can also take place through more complex, linear or nonlinear assignments (cluster assignment, neural networks, etc.). The comparison leads ultimately to a comparison result.

The comparison result obtained from step S3 is used in a computing facility according to step S4 in order to ascertain a value which represents or contains a measure of the level of closure. In the concrete example shown in FIG. 2, the level of closure is explicitly estimated from the comparison value. This means that an explicit mapping to an effective vent is performed in step S4. The result is thus an estimate of the current, individual level of closure.

With regard to the adjustment, the level of closure is then taken into consideration in step S5 by the fact that the gain is corrected in accordance with the level of closure. To this end, the level of closure is for example automatically set and taken into consideration in the adjustment formula.

In a special embodiment the data from the OLG measurement can be input directly into a model for vent inflow and outflow. In this model, the comparison according to step S3 and the determination of the level of closure according to step S4 or of a corresponding value take place indirectly. The adjustment then occurs on the basis of the vent inflow and outflow. Through this it is possible to dispense with an explicit mapping to the effective vent.

Figure 2:
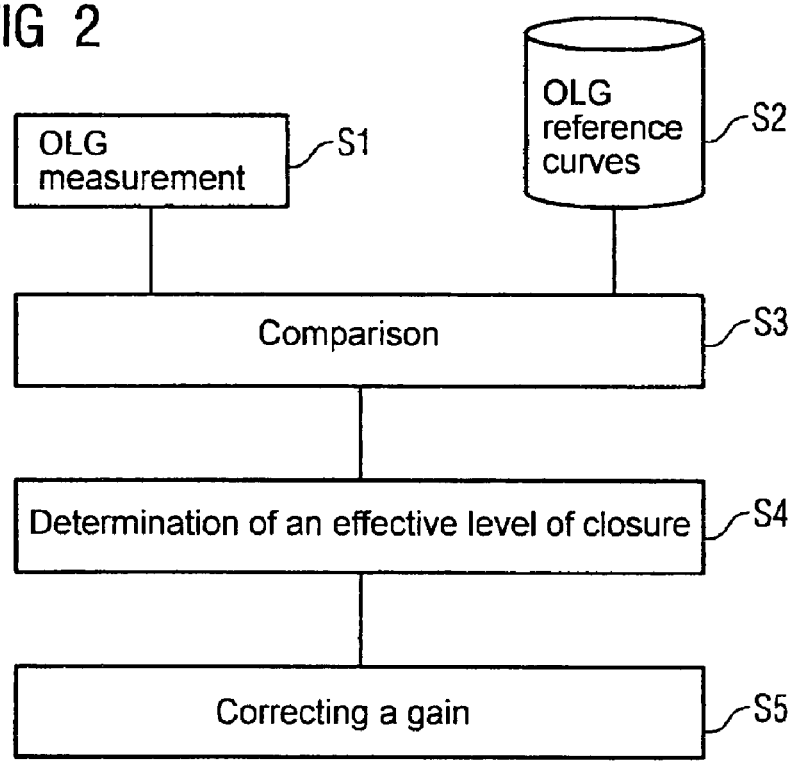

In an advantageous manner, through the embodiment of a method according to the invention illustrated by way of FIG. 2 or by using a corresponding device, it is possible to take into consideration the individual level of closure during the adjustment of the hearing aid in such a way that an enhanced fit and acceptance can be achieved. This means that at least with regard to the consideration of the level of closure no individual otoplastic is required and an instant fit ear tip can be used. A further advantage of the approach described here, to determine the level of closure with the aid of an OLG measurement, consists in the fact that the OLG measurement can be performed simply in the case of hearing aids and is frequently undertaken anyway, particularly for so-called open fit devices for open fitting, which represent a primary application for the instant fit ear tips.

The invention claimed is:

1. A method for determining an effective vent of a hearing aid, comprising:

measuring an open loop gain on the hearing aid;

comparing the measured open loop gain with an open loop gain reference curve; and determining the effective vent by a value indicating a level of closure of the hearing aid in an ear of a wearer of the hearing aid based on the comparison.

2. The method as claimed in claim 1, wherein the open loop gain is measured in a plurality of predefined band ranges.

3. The method as claimed in claim 1, wherein the open loop gain is measured and compared only in a low-frequency range.

4. The method as claimed in claim 1, wherein the measured open loop gain is compared with the open loop gain reference curve by a distance measurement.

5. The method as claimed in claim 1, wherein the measured open loop gain is compared with the open loop gain reference curve through a cluster assignment.

6. The method as claimed in claim 1, wherein a gain of the hearing aid is corrected based on the determined value with respective to the level of closure.

7. The method as claimed in claim 1, wherein the determined value indicates a level of closure of an otoplastic of the hearing aid in the ear of a wearer of the hearing aid.

8. A method for adjusting an gain of a hearing aid, comprising:

measuring an open loop gain on the hearing aid;

comparing the measured open loop gain with an open loop gain reference curve;

determining a value indicating a level of closure of the hearing aid in an ear of a wearer of the hearing aid based on the comparison; and correcting the gain of the hearing aid based on the determined value with respective to the level of closure.

9. The method as claimed in claim 8, wherein the open loop gain is measured in a plurality of predefined band ranges.

10. The method as claimed in claim 8, wherein the open loop gain is measured and compared only in a low-frequency range.

11. The method as claimed in claim 8, wherein the measured open loop gain is compared with the open loop gain reference curve by a distance measurement.

12. The method as claimed in claim 8, wherein the measured open loop gain is compared with the open loop gain reference curve through a cluster assignment.

13. The method as claimed in claim 8, wherein the determined value indicates a level of closure of an otoplastic of the hearing aid in the ear of a wearer of the hearing aid.

14. A device for determining an effective vent of a hearing aid, comprising:

a measuring unit that measures an open loop gain on the hearing aid; and a computing unit that:

compares the measured open loop gain with an open loop gain reference curve, and determines the effective vent by a value indicating a level of closure of the hearing aid in an ear of a wearer of the hearing aid based on the comparison.

15. The device as claimed in claim 14, wherein the open loop gain is measured in a plurality of predefined band ranges.

16. The device as claimed in claim 14, wherein the open loop gain is measured and compared only in a low-frequency range.

17. The device as claimed in claim 14, wherein the measured open loop gain is compared with the open loop gain reference curve by a distance measurement.

18. The device as claimed in claim 14, wherein the measured open loop gain is compared with the open loop gain reference curve through a cluster assignment.

19. The device as claimed in claim 14, wherein the computing unit determines a gain correction value of the hearing aid based on the determined value with respective to the level of closure.

20. The device as claimed in claim 14, wherein the determined value indicates a level of closure of an otoplastic of the hearing aid in the ear of a wearer of the hearing aid.

* * * * *